United States Patent [19]

Erdei

[11] Patent Number: 4,712,344

[45] Date of Patent: Dec. 15, 1987

[54] DOME SLAB BUILDING STRUCTURE AND METHOD

[76] Inventor: Karoly Erdei, 1607-C Amberwood Dr., South Pasadena, Calif. 91030

[21] Appl. No.: 40,764

[22] Filed: Apr. 15, 1987

Related U.S. Application Data

[63] Continuation of Ser. No. 722,612, Apr. 12, 1985, abandoned.

[51] Int. Cl.[4] ..... E04C 3/10

[52] U.S. Cl. ..... 52/223 R; 52/251

[58] Field of Search ..... 52/223 L, 223 R, 230, 52/80, 87, 329, 251, 252, 260

[56] References Cited

U.S. PATENT DOCUMENTS

| | | | |
|---|---|---|---|
| 1,005,756 | 10/1911 | Sinks | 52/252 |
| 2,128,137 | 8/1938 | Godson | 52/252 |
| 3,383,816 | 5/1968 | Hodson | 52/329 |
| 3,477,080 | 11/1969 | Finsterwalder | 52/251 |
| 3,567,816 | 3/1971 | Embree | 52/223 |
| 4,470,233 | 9/1984 | Murakami | 52/260 |

FOREIGN PATENT DOCUMENTS

| | | | |
|---|---|---|---|
| 680627 | 8/1939 | Fed. Rep. of Germany | 52/252 |
| 844347 | 6/1952 | Fed. Rep. of Germany | 52/251 |
| 248745 | 6/1926 | Italy | 52/87 |

OTHER PUBLICATIONS

Engineering News-Record, Mar. 2, 1950, pp. 34, 35, 36 and 37.

*Primary Examiner*—Henry E. Raduazo
*Attorney, Agent, or Firm*—William P. Green

[57] ABSTRACT

A building structure and method provides a cast floor supported on columns, the floor including a bottom surface having a dome-shaped region supported by at least three of the columns, the floor having a thickness that gradually increases in all directions outwardly from a crown in the dome-shaped region. The floor is reinforced by post-tensioning members that sag from near a top surface at polygonal cell region boundaries, the corners of which are at the columns supporting the dome-shaped region, to near the bottom surface for compressively stressing the cast material and upwardly biasing the floor. The floor is economically constructed using modern fly-form modules equipped with dome-shaped formwork.

25 Claims, 6 Drawing Figures

12
14-3
14-6
16
20
22
24
26
30
40
41
42
43
44
45
46
48
50
51
52
54
56
102
5

FIG. 3
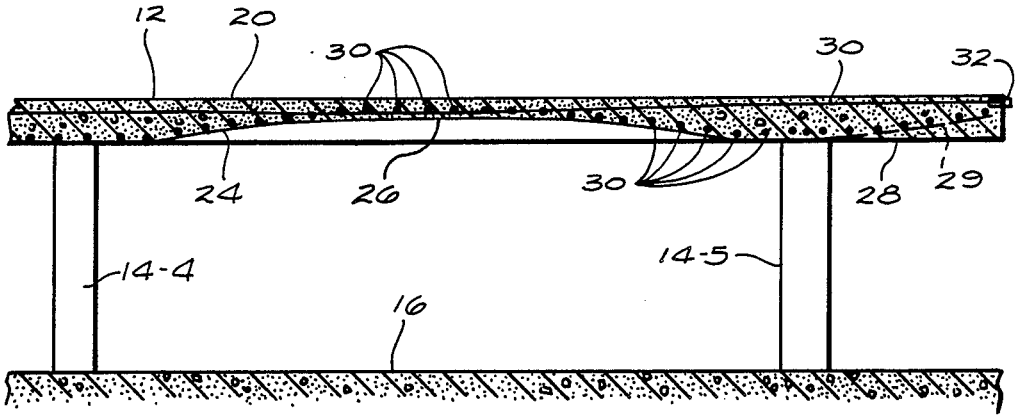
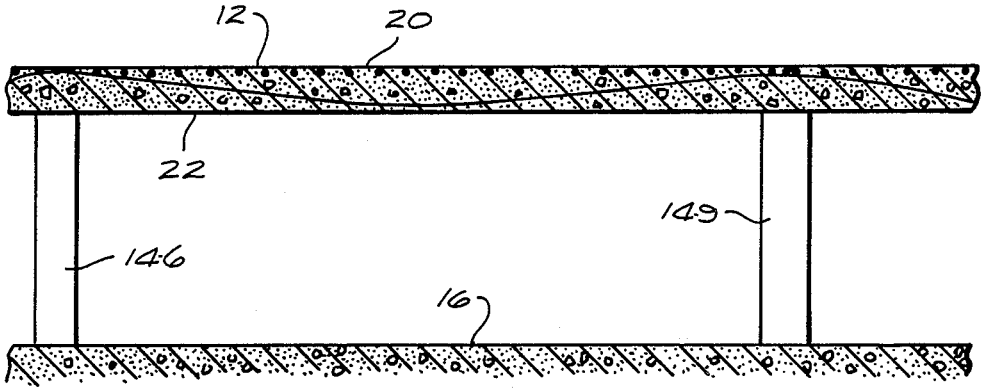
FIG. 4
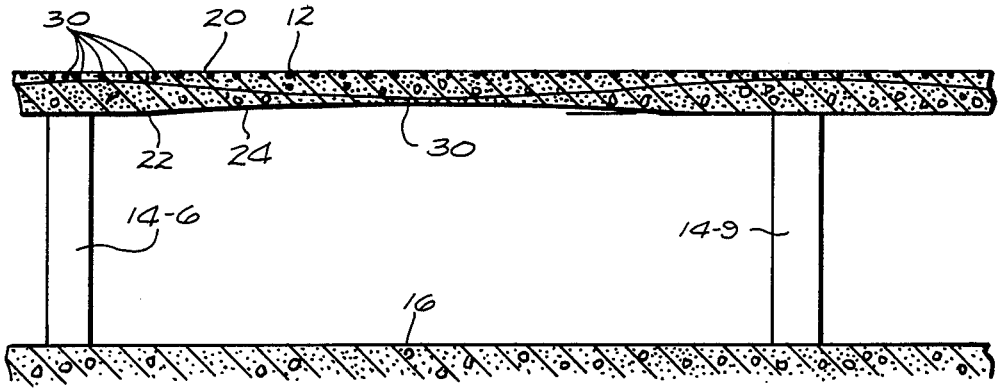
FIG. 4A

DOME SLAB BUILDING STRUCTURE AND METHOD

This is a continuation of co-pending application Ser. No. 722,612 filed on Apr. 12, 1985 and now abandoned.

BACKGROUND

The present invention relates to building construction and more particularly to improved structures and buildings of prestressed concrete, reinforced concrete and the like.

Many buildings, such as offices, meeting and concert halls, churches, theatres, and parking structures require large floor spans because of functional requirements. A large number of such structures of the prior art have heavy beam and slab floor construction, comprising relatively deep beams of about three foot depth supporting a deck slab, the beams in turn being supported by columns.

The beam and slab construction of the prior art is either cast in place, or "precast" post-tensioned concrete consisting of large, heavy elements delivered to and assembled on the site, or steel beam and column elements supporting a concrete deck.

This type of construction has significant problems. For example, the deep beams hang down over the floor below, restricting the space between floors. This problem is accentuated in parking structures, where the columns need to be widely separated. In parking structures the floors normally span over 60 feet to allow a stall twenty feet in length on each side of a driveway, plus 23 feet minimum for the driveway. In a typical parking structure having beam and slab construction, the floor beams or girders, spaced 10 to 25 feet apart must be 30 to 40 inches deep. Since the floors are only 10 feet apart vertically, the volume required for the floor construction is about $\frac{1}{3}$ of the height of the parking structure. This is lost space that cannot be utilized, and money has to be paid for this wasted space by the owner of the parking structure.

Another disadvantage of current beam and slab construction is restricted headroom. About one out of four private vehicles in many localities are vans and small pick-up trucks that are excluded from most existing parking structures. New laws for handicapped easy access are being passed that cannot be enforced without making the parking structures much more expensive. The floor-to-ceiling height must be raised by more than 18 inches to permit access of vehicles transporting the handicapped (usually vans, small buses, pick-ups).

Another disadvantage is that these beam-slab structures are very expensive, laborious and time-consuming to construct, especially the cast-in-place concrete or structural steel versions.

In the case of cast-in-place concrete which is normally post-tensioned, a large number of reinforcing devices in the form of stirrups, bars, tendons, and the like have to be formed and placed individually with progressive spacing and tied together to form a cage of reinforcement before the concrete is poured in the formwork. Thus forming of the beams is expensive, time-consuming, laborious and complicated. The placement and tying together of the individually bent and progressively spaced reinforcement members are particularly difficult to supervise and inspect, greatly increasing the cost of the building.

The precast post-tensioned type of construction introduces other disadvantages. Especially serious is that it relies on "dry" connections between beams and columns, wherein the beams rest on small bearing areas or corbels that protrude from the columns. A relatively modes tremor can introduce sufficient lateral displacement to the columns to remove a small bearing area from the beams, allowing the floor to come crashing down.

Another method for constructing buildings, called "flat slab construction", is to leave out the beams. The beams can be left out by reducing the spacing between columns. The flat slab construction lends itself to modern production techniques, such as fly-forming, wherein a portable, flat-top form is positioned to define the bottom surface of poured concrete for the floor. Once the concrete has set, the form can be relocated to another floor region and re-used. The floor, which can include steel reinforcing bars and/or post-tensioning tendons, is typically eight or ten inches thick.

A disadvantage of flat slab construction is that the column spacing must be about 30 feet or less, even in lightly loaded structures. In a parking structure, for example, the effective live load is only about 30 pounds per square foot, but the floor itself contributes more than 100 pounds per square foot to the total load. Increasing the floor thickness is impractical because of the extra weight and expense of the added material. Thus, flat slab construction is unsuited to many building applications demanding spans of 60 feet or more.

A further disadvantage of each of the prior art building structures is that a great proportion of the weight of the floor is located near the center of the slab, farthest from the columns. Consequently, the building has a low resistance to vibration, especially in a vertical direction.

Accordingly there is a need for a building structure and method that permits large floor spans without requiring deep floor beams, that is safe and reliable, and inexpensive to produce.

SUMMARY

The present invention meets this need by using a dome-slab structure having a dome-shaped bottom surface in a cast floor of a building. The building comprises a plurality of floor supports on which rest a floor having a top load-carrying surface and a bottom surface including a concave dome recess. The floor supports can be substantially vertical columns.

The thickness of the floor at the dome recess is a minimum at a crown of the dome recess and increases continuously outwardly in all directions from the crown. The dome-shaped bottom surface advantageously reduces the weight of the floor while permitting the floor load to be transmitted smoothly and efficiently toward the supports. A polygonal cell recess of the floor is defined by the location of the supports surrounding the dome recess.

The cell recess can be rectangular, and a locus of points on the dome recess equidistant from the top surface preferably forms an ellipse.

Preferably the cell region is a regular polygon such as a square and a locus of points on the dome recess equidistant from the top surface is a circle.

The dome recess can be comprised of one single geometrical surface or of a plurality of geometrical surfaces to form the concave dome recess.

The floor can be cantilevered beyond a cell boundary for preventing excessive unbalanced bending moments in the floor supports. Thus a floor having one cell only can be used advantageously when cantilever edges are provided.

The floor can have a plurality of the dome recesses, at least some of the dome recesses and corresponding cell regions forming a continuous pattern for preventing the excessive unbalanced bending moments in the floor supports. The continuity can be preserved at a boundary of the pattern by cantilevering the floor beyond the boundary.

Preferably the structure includes tensioning strands for transversely compressing the cast floor material for limiting tension stress in the material, the strands each intersecting at least two sides of the cell region, at least some strands being located over the dome recess. Preferably at least some strands intersect the sides of the cell close to the top surface and sag close to the bottom surface for upwardly biasing the floor between the supports.

The structure can be a building having a plurality of vertically displaced floors, the floors being supported by columns, at least some of the floors having a dome-shaped bottom surface over an area between at least some of the columns.

The structure of the present invention concentrates the floor material toward the supports, away from the central portion of the cell, thereby providing greater strength and stiffness, and a significant improvement in vibration resistance over structures of the prior art.

A method for producing the structure of the present invention includes the steps of:

(a) constructing a plurality of substantially vertical floor supports;
(b) placing a main formwork for temporary floor support within the cell region;
(c) providing a dome formwork on the main formwork;
(d) pouring a material for casting the floor onto the main formwork and the dome formwork to an elevation above the elevation of the dome formwork;
(e) finishing the poured material for forming a top floor surface, the material having a thickness increasing continuously in all directions outwardly from the crown on the dome formwork; and
(f) after the poured material has solidified, optionally removing the main formwork and the dome formwork for exposing a bottom surface of the floor.

The main formwork can be a modular fly-form structure, the dome formwork comprising separate segments, the segments being located on corresponding fly-form modules. Alternatively, the dome formwork can be a single, non-segmented forming device.

The dome-shaped formwork can comprise a flexible member and the method can include the step of inflating the flexible member to form a desired contour of the dome-shaped structure. The step of removing the main formwork and the dome formwork can include the step of deflating the flexible member.

Thus the dome-slab structure, by concentrating the floor material close to the supports, can span large areas without requiring deep floor beams. Without the deep floor beams, the vertical spacing between floors can be decreased and/or increased headroom can be provided.

The structure is safe and reliable in that the floor is unitary, not separate modules that can slip off of dry column floor connections. The concentration of weight and strength close to the supports provides excellent vibration resistance. Further, the amplitude of vertical deflections of the floor can be less than the amplitude of vertical deflections of prior art floor structures.

The structure is inexpensive to produce in that complex beams are not required, and fewer columns are required than in flat slab construction. The simplicity and low draft of the dome-slab structure permits rapid, low-cost, mechanized forming methods to be used. All of these advantages are obtained without the use of beams. Thus a floor having a dome-shaped bottom surface can span very large distances, as much as 100 feet, without beams. This compares very favorably with flat slab construction which is limited to 30 feet spans.

DRAWINGS

These and other features, aspects, and advantages of the present invention will become better understood with reference to the following description, appended claims, and accompanying drawings where:

FIG. 3 is a fragmentary sectional elevational view of the structure of FIG. 1 taken along line 3—3 in FIG. 1;

FIG. 4 is a fragmentary sectional elevational view of the structure of FIG. 1 taken along line 4—4 in FIG. 1;

FIG. 4*a* is an alternate configuration of FIG. 4; and

Figures 2, 5:
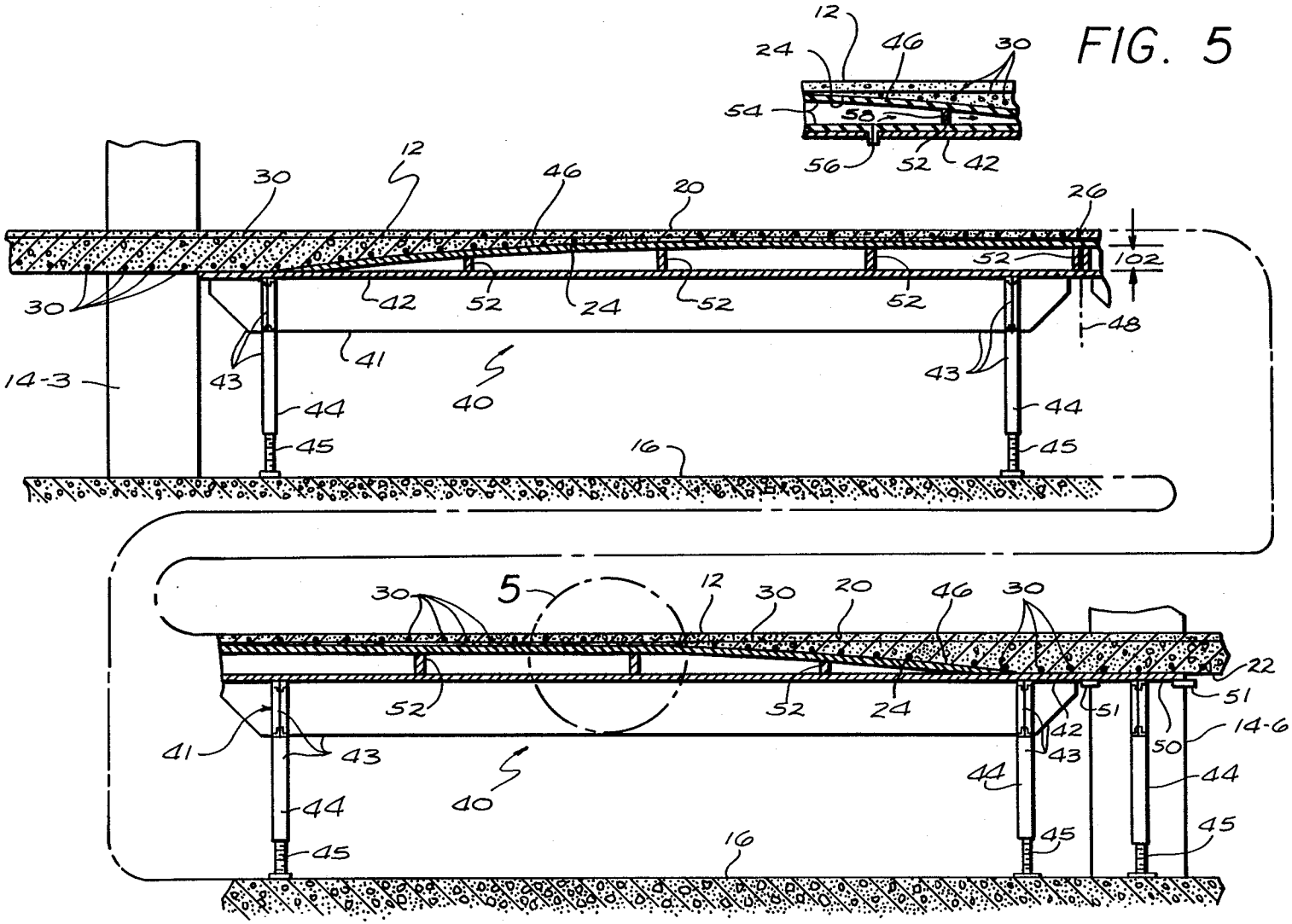
FIG. 2 is a fragmentary sectional elevational view of the structure of FIG. 1 taken along line 2—2 in FIG. 1.

FIG. 5 is a fragmentary sectional elevational view showing an alternate configuration of the forms within region 5 in FIG. 2.

DESCRIPTION

The present invention is directed to a dome-slab building structure and method for providing a large uninterrupted floor span without requiring excessive floor thickness. With reference to FIGS.1–4, a building structure 10 includes a cast floor 12, the floor 12 being supported by a plurality of columns 14. As shown in the Figures, the columns can extend above the floor 12 for supporting additional structure (not shown). Th columns 14 in turn, are supported on a base 16. The base 16 can be a lower floor of a multi-story structure or the base support for a one story or multi-story building. The columns 14 are substantially vertical, being inclined at least about 85 degrees from a horizontal plane.

Figure 1:
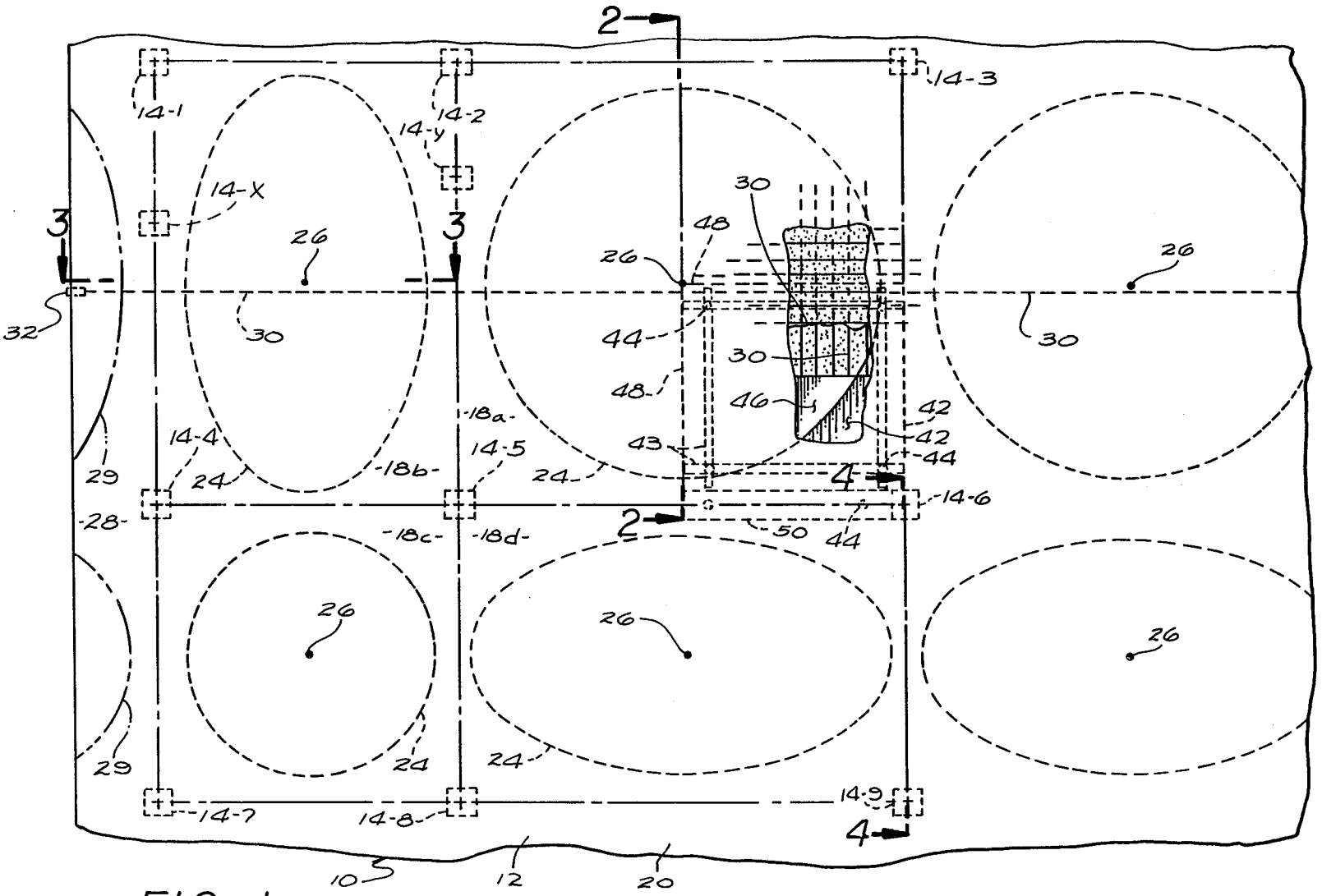
FIG. 1 is a fragmentary plan view of the building structure of the present invention, including forms for casting a floor of the structure.

At least three of the columns 14 are located at the corners of a polygonal cell region 18 of the floor 12, typical cell regions being designated 18*a*, 18*b*, 18*c*, and 18*d* in FIG. 1. A cell region is that portion of a floor structure whose boundaries are surrounded by supports and does not include any essential supports within its area. For example, columns 14-2, 14-3, 14-5, and 14-6 are at the corners of region 18*a*; columns 14-1, 14-2, 14-4, and 14-5, are at the corners of region 18*b*; columns 14-4, 14-5, 14-7, and 14-8 are at the corners of region 18*c*; and columns 14-5, 14-6, 14-8, and 14-9 are at the corners of region 18*d*. The regions 18*b* and 18*d* are rectangular, the regions 18*a* and 18*c* are square. The region designations identify recesses within the continuous floor 12, not structural interfaces. "Square" and "circle" are included special cases of the terms "rectangle" and "ellipse", respectively.

The pattern of rectangular and square regions 18 in the drawings is for illustration only, a preferred pattern being regular as described below. The cell recesses can be irregular or regular, with the columns regularly or irregularly spaced apart.

Additionally, adjacent sides of a polygonal region 18 can be aligned with three or more columns of the region 18 located along a straight line. This situation is illustrated in FIG. 1 by the addition of auxiliary columns 14-X and 14-Y. Moreover, a wall can be formed on a side of a region, the wall being analogous to a series of joined columns. Such a wall can be straight or curved.

The columns 14 are also understood to include piers and/or footings in appropriate situations.

The floor 12 has a top surface 20 that can be level or sloping, flat or slightly curved, as functional requirements dictate. The floor 12 also has a bottom surface 22, further described herein.

A principal feature of the present invention is that an area supported by at least some of the columns 14 within the bottom surface 22 has a concave portion or dome recess 24. The dome recess 24 is curved downwardly, away from the top surface 20, smoothly and continuously in all directions outwardly from a near point or crown 26, the crown 26 being generally centrally located within the cell 18. The dome recess 24 reduces the weight of the floor 12 within the cell 18 which permitting high load-carrying capacity. The smooth surface of the dome recess 24 prevents harmful stress concentration while advantageously distributing the bulk of the cast material of the floor 12 outwardly toward the columns 14. Thus the strength and rigidity of the structure increases gradually and steadily toward the columns.

Preferably a dome recess 24 is contained completely within a cell region 18, although a dome recess 24 can be contained in a plurality of cell regions. Further, dome recesses can overlap.

If the floor loading within the region 18 is permanently located predominately to one side of the cell, the crown 26 may be advantegeously located off-center within the region 18.

The dome recess 24 can be formed in a variety of shapes within the scope of the present invention. In elevation, for example, the dome recess 24 can be circular, elliptical or parabolic in any degree. In most applications, the depth or camber of the dome recess 24 is small in relation to its bredth.

Typically, the floor 12 has a maximum thickness of only about 16 to 18 inches, the crown 26 being about five inches below the the surface 20, while the region 18 spans 40 to about 100 feet. The dome recess 24 has a height (defined below) of only about one foot, and extends from about 30 to as much as about 100 feet. In such cases, a change from one sectional form to another makes little difference in the actual shape of the dome recess 24. Thus the mathematical form of the sectional shape of the dome recess 24 is normally of secondary importance.

Further, the dome recess 24 can comprise one or more geometrical surfaces. A geometrical surface is a surface that is continuous within its boundaries. Thus the dome recess 24 can be segmented, having different degrees of curvature. Moreover, the dome recess 24 can include flat segments.

Preferably at least 20% of the floor surface area comprises dome recesses, and more preferably at least 40%, to obtain the advantages associated with the use of dome recesses. The domes are very flat; they are not arches. Generally the ratio of the equivalent diameter of a dome to its height at the crown is 10:1 or 20:1 to about 200:1, preferably from about 30:1 to about 100:1. The "equivalent diameter" of a dome recess is the diameter of a circle having an area equal to the floor area directly over the dome recess. The "height" of a dome recess at its crown (dimension 102 in FIG. 2) is the difference between the floor thickness at the edge of a dome recess and the floor thickness at the crown.

In this connection, the terms "smoothly" and "continuously", relating to the increasing thickness of the floor 12 at the dome recess 24, includes approximations of a theoretically smooth and perfect dome shape. Thus the dome recess 24 can include imperfections and small steps within the scope of the present invention.

Unless the floor loading is highly unsymmetrical, the preferred shape of the dome recess 24 in plan is primarily dependent on the shape of the cell 18. In an elongated region such as the rectangular regions 18*b* and 18*d*, the dome recess 24 is preferably oval or elliptical in plan. The shape of the dome recess 24 in plan properly refers to the shape of a locus of points on the dome recess 24 that are equidistant from the top surface 20, in order to properly account for a non-level top surface 20 of the floor 12. The dome recesses 24 do not have to be symmetrical in shape. Also, the periphery of the dome recesses do not have to curved. For example, the dome recesses can be shaped like irregular polygons.

Preferably, the region 18 comprises a regular polygon for efficient symmetrical loading of the floor 12 wihin the region 18, the dome recess 24 being circular in plan. Moreover, in a structure 10 having a plurality of the dome recesses 24, it is preferred that all or a large proportion of the corresponding cells 18 form a continuous symmetrical pattern for simplicity of design and ease of construction and supervision.

A further advantage of the continuous symmetrical pattern of the regions 18 is that the columns 14 within the symmetrical pattern are not required to carry unbalanced bending moments from the floor 12. The symmetrical pattern preferably comprises regular polygonal regions 18, such as equally sized square, hexagonal, or equilateral triangular regions 18.

In order to avoid excessive unbalanced bending moments in the columns 14 at the extremities of the structure 10, the floor 12 can be cantilevered beyond the extreme columns 14 as shown in FIG. 3, forming an overhang 28. For proper balancing of the moments, the overhang 28 can extend about one-quarter of the span of an adjacent region 18, more or less depending on functional requirements. The overhang 28 can be plain, the bottom surface 22 thereof being parallel with the top surface 20. Alternatively, the overhang 28 can include one or more dome segment recesses 29.

The cantilevered overhang 28 can be used advantageously at an extremity of the continuous pattern of the regions 18 described above. In addition to the extremities of the structure, this feature can be provided at any location in the floor where dictated, for example, by fucntional restrictions on the use of the floor.

As shown in FIGS. 1–4, the bottom surface 22 of the floor 12 can be parallel with the top surface 20 near the columns 14 and at the sides of the regions 18 for ease of construction and for limiting the thickness of the floor 12. Thus the intersections of the dome recesses 24 with the balance of the bottom surface 22 are elliptical and circular in the respective rectangular and square regions 18.

Alternatively, the bottom surface 22 can be curved along at least a portion of the region boundary, as shown in FIG. 4*a*. The curvature of the bottom surface 22 at the region boundary can be generated by enlarging the dome region 24, the dome 24 intersecting the boundary of the cell 18. Moreover, the dome region 24 can be enlarged to the extent that none of the bottom surface 22 within the region 18 remains parallel with the top surface 20.

The floor 12 comprises cast concrete or other suitable material, either non-stressed, reinforced, prestressed, pre-tensioned, or post-tensioned, as these terms are understood by those skilled in structural engineering and in building construction. Concrete and other suitable cast structural materials perform well under compressive loading, but poorly in tension. The dome-shaped bottom surface 22 advantageously contributes to reduced tension stresses in the floor 12. The preferred form of the present invention includes one or more of the above reinforcing means when concrete or other material weak in tension is used.

As shown in FIGS. 1–4, the structure of a preferred version of the present invention includes post-tensioning reinforcement. A plurality of tendons or strands 30, which can be cables, rods, or other suitable tension members are enclosed in sleeves (not shown) and cast in place according to a predetermined pattern. The strands 30 are free to move axially in the sleeves and are received in anchors 32 at opposite sides of the structure, one of the anchors 32 being shown schematically in FIG. 3. After the cast material has solidified, tension is applied to the strands 30 by methods known by those skilled in the art. The tension in the strands 30 advantageously loads the cast material of the floor 12 in compression for limiting tension stresses in the material.

The floor structure can also include unstressed reinforcement such as reinforcing bars.

The strands 30, extending to oppositie sides of the floor 12, intersect two sides of a cell region 18 proximate to the top surface 20. At least some of the strands 30 pass over the dome recess 24 for compressively reinforcing the cast material of the floor 12 above the dome recess 24.

Preferably at least some of the strands 30 are curved downwardly from the top surface 20 and sag proximate to the bottom surface 22 for upwardly biasing the floor 12 between the columns.

Additionally, some of the strands 30 pass proximate to adjacent columns 14 of the cell region 18, sagging between the columns for upwardly biasing the floor 12 along the boundary of the cell recess 18. The principle of biasing a structure in a direction normal to the curved path of a post-tension device such as a tendon, used in the present invention, is known to those skilled in the art.

In combination with the dome recess 24 of the present invention, the curved strands 30 are uniquely advantageous in that maximum upward biasing is provided where it is most needed—along the boundaries of the regions 18. The high upward biasing along the boundaries is needed to support the strands 30 that cross the boundaries, passing over the dome recess 24. Of these, the strands 30 that are laterally located proximate to the crown 26 have lesser sag, carry less load, and are required to produce lesser biasing. Conversely, the strands 30 that are laterally located partway between the crown 26 and a boundary of the region 18 have medium sag, both producing and requiring a medium amount of biasing. Fortuitously, the upward biasing required along a boundary for supporting the stands 30 crossing the boundary is greatest nearest the columns 14, where the strands 30 that pass along the boundary are most effective in providing the upward biasing.

The strands 30 are most effective when intersecting each other at large angles. When the regions 18 are square or rectangular as shown in FIG. 1, for example, the strands 30 preferably comprise two groups intersecting each other and the region boundaries at 90 degrees.

In the preferred version of post-tensioned, reinforced concrete, the present invention economically provides uninterrupted floor spans of 40 feet square to more than 70 feet square with a maximum floor thickness of only 18 inches.

The building structure 10 of the present invention can be constructed using rapid mechanized forming methods. This is because complicated, intricate cast shapes and complex, individually bent and located reinforcing elements are not required, as in conventional beam-and-slab construction.

With reference to FIGS. 1 and 2, the columns 14 can be constructed on the base 16 in any conventional manner, being located for defining at least one of the regions 18 as described above.

A temporary form system 40 is next placed for defining the bottom surface 22 of the floor 12. The form system 40 comprises a main formwork 41, having a generally horizontal main form panel 42 for forming a portion of the bottom surface 22. The main form panel 42 comprises any suitable material, such as plywood. The main formwork 41 also includes a metallic supporting structure or frame 43, and a plurality of props or jacks 44 for adjustably supporting the main form panel 42. The jacks 44 include corresponding jack screws 45 that are turned when adjusting the height of the main form panel 42.

The principal feature of the form system 40 is a dome formwork 46, further described herein, that is located on the main formwork 41. The dome formwork 46 provides forming for the dome recess 24, including the crown 26, of the floor bottom surface 22.

A suitable structural material is poured onto the dome formwork 46 and the main formwork 41, to a predetermined elevation above the crown 26 for casting the floor 12. The material is then finished with a thickness increasing continuously in all directions outwardly from the crown 26.

When the cast material has solidified, the form system 40 can be removed or "struck", exposing the bottom surface 22 of the floor 12. The dome formwork 46 is usually removed, but can be left in place for the life of the building.

The form system 40 can be adapted from conventional reusable fly-form modules for rapidly and inexpensively forming the floor 12. The dome formwork 46, in the form of segments, is attached to corresponding fly-form modules. In the drawings, adjoining modules of the form system 40 meet at a module interface 48.

Between modules, a filler panel 50 can connect between separated portions of the main formwork 41. The filler panel 50 is supported similarly to the main formwork 41 on a pair of the jacks 44. A pair of jams 51, on opposite sides of the filler panel 50, engage the separated portions of the main formwork 41 stabilizing the panel and providing a labyrinth seal for the cast material.

The dome formwork 46 can be constructed of plywood, steel, plastic fiberglass, resin, and/or other suitable materials, supported by a plurality of ribs 52 on the main formwork 41. The dome formwork 46, being shallow in relation to its breadth for forming the dome recess 24 as described above, can be accurately produced by reasonably sized panels of the plywood or other flat material.

A shown in FIG. 5, the dome formwork 46 can comprise an inflatable, flexible member 54. The flexible member 54 has a filler device 56, the filler device 56 being accessible through the main form panel 42 to permit the bubble 46 to be inflated with any suitable fluid, a gas, liquid or granular material, such as air, water, sand, etc. The flexible member 54 permits the shape of the dome recess 24 to be controlled by varying the volume of the fluid in the flexible member 54. The flexible member 54 can incorporate the ribs 52 for limiting expansion of the dome formwork 46, each rib 52 having a passage 58 for permitting the fluid to flow through the rib 52. Striking of the form system 40 can include deflating the flexible member 54 of the dome formwork 46 for facilitating relocation and/or removal of the form.

Thus the construction method of the present invention provides the structure 10 having a dome-shaped bottom floor surface, creating a concentration of the cast floor material close to the supporting columns 14. Because a large proportion of the total floor loading in a building structure is the weight of the cast floor material itself, the structure 10 has greater load-carrying capacity and stiffness, and/or reduced floor thickness than the structures of the prior art. The reduced floor thickness provides greater headroom and/or decreased floor spacing that permits a lower overall height of the structure 10.

The structure 10 is particularly advantageous in parking garages, offices, public buildings, and dwellings for providing a floor surface highly suited to drive on, park on, or walk on, that is capable of spanning long distances, yet has a shallow structural floor thickness.

The combination of greater stiffness and the concentration of material close to the supports dramatically increases the vibration resistance of the structure 10, especially in the vertical direction. This combination is particularly advantageous for housing heavy machinery and in regions of high seismic and wind activity.

Although the present invention has been described in considerable detail with regard to certain versions thereof, other versions are possible. For example, selected areas of the floor 12 can be made lighter by inserting forms for creating voids of any desired shape in the cast material. Also, all or portions of the floor 12 can be prefabricated and transported to the building site, the prefabricated portions being joined together and to cast-in-place portions, if any, at the site. In addition, the floor thickness can include a step increase at the peripheral edge of the dome recess 24. The dome formwork 46 can rest directly on the frame 43, instead of the form panel 42. Further, the floor 12 can be fabricated by removing material from a workpiece, such as by machining or dissolving the material. Moreover, the floor 12 can comprise any suitable material, including metal and/or plastic. Therefore, the spirit and scope of the appended claims should not necessarily be limited to the description of the versions contained herein.

What is claimed is:

1. A building structure comprising:

a series of support columns projecting upwardly at different locations about a region and spaced apart along the periphery of said region; adn a floor supported locally at said locations by said spaced columns and extending from said columns across said region;

said floor including a monolithic integrally cast body of concrete having a top surface for supporting a load and having a bottom surface which, as it extends inwardly across said region from the periphery thereof, is shaped to form a shallow concave dome recess in the underside of said body;

the thickness of said body of concrete between said top and bottom surfaces increasing progressively and gradually in all directions outwardly from a crown portion of the dome recess to the preiphery thereof;

the ratio of the diameter of a circle having an area equal to the area of the floor over the dome recess to the height of the dome recess at said crown portion being at least about 20 to 1;

said floor including a plurality of tendons extending within said body of concrete across said region and through the concrete body above said dome recess;

the individual tendons, in extending across said region within said concrete boyd, being bowed to advance first gradually away from said top surface from one side of said region toward an intermediate location above the dome recess and then gradually closer to said top surface toward the opposite side of said region, and being tensioned to apply an upward biasing force and a lateral compressive force on the body of concrete across said region and above said dome recess.

2. A building structure as recited in claim 1, in which said ratio is between about 20 to 1 and 200 to 1.

3. A building structure as recited in claim 1, in which said ratio is between about 30 to 1 and 100 to 1.

4. A building structure as recited in cliam 1, in which said tendons are closer to said top surface of the floor body than to said bottom surface at the periphery of said region, and are closer to said bottom surface than to said top surface at said intermediate location above the dome recess.

5. A building structure as recited in claim 1, in which a group of said tendons extend essentially parallel to one another across said region in horizontally spaced relation, said group of tendons including an essentially central tendon or tendons crossing over said dome recess at essentially the location of said crown portion thereof and two series of additional tendons offset laterally in opposite directions from said crown portion of the dome recess, successive tendons of each of said series of additional tendons being bowed progressively farther downwardly at their centers to be closely proximate progressively lower portions of said dome recess.

6. A building structure as recited in claim 1, in which some of said tendons extend essentially perpendicular to others of the tendons in crossing said region.

7. A building structure as recited in claim 1, in which said tendons include a first group of said tendons extending generally parallel to one another in a first generally horizontal direction across said region and within said concrete body, and a second group of said tendons extending generally parallel to one another across said region and within said concrete body and generally perpendicular to the tendons of said first group.

8. A building structure as recited in claim 1, including additional tendons extending within said concrete body along the periphery of said region and between successive ones of said support columns and which are bowed downwardly between the support columns and tensioned to apply upward biasing and horizontal compressive forces on the concrete between the support columns.

9. A building structure as recited in claim 1, in which said region is essentially rectangular in horizontal section and has four of said support columns extending essentially vertically at the corners of said rectangular region.

10. A building structure as recited in claim 9, in which the horizontal outline configuration of the dome recess is essentially an ellipse.

11. A building structure as recited in claim 1, in which said region is of essentially regular polygonal configuration in horizontal section, and has said support columns at corners of said regular polygonal region, and said dome recess is essentially circular in horizontal section.

12. A building structure as recited in claim 1, in which said floor is cantilevered outwardly beyond at least one of said support columns.

13. A building structure as recited in claim 1, in which said bottom surface curves essentially smoothly and gradually across the entire extent of said dome recess.

14. A builiding structure as recited in claim 1, in which the thickness of said body of concrete between said top and bottom surfaces increases substantially continuously in all directions outwardly from said crown portion of the dome recess to the periphery thereof.

15. A building structure as recited in claim 1, in which said bottom surface of said concrete body of the floor has a portion which is substantially planar and substantially parallel to said top surface of said body at locations about said dome recess.

16. A building structure as recited in claim 1, in which sad top surface of said concrete body of the floor is substantially flat above said dome recess and laterally outwardly therebeyond.

17. A building structure as recited in claim 1, in which said monolithic integrally cast body of concrete is continuous across a plurality of said regions, with support columns spaced about each of said regions and with said bottom surface forming a plurality of said dome recesses in said regions respectively each having dimensions with said ratio, and with bowed tendons above each of said dome recesses tensioned to apply upward biasing and lateral compressive forces.

18. A building structure as recited in claim 17, in which at least some individual tendons extend across a plurality of said regions and a plurality of said dome recesses.

19. A building structure as recited in claim 1, including a plurality of vertically spaced floors at least some of which contain said dome recesses and bowed tendons thereabove.

20. A building structure as recited in claim 1, in which said floor is inclined.

21. A building structure comprising:

a series of generally vertically extending support columns projecting upwardly at spaced locations defining an essentially polygonal region; and a floor supported by said columns and extending across said polygonal region;

sadi floor including a monolithic integrally cast body of concrete having a top surface for supporting a load and having a bottom surface which, as it extends inwardly from said columns and across said region, has a portion advancing progressively closer to said top surface to form a shallow concave dome recess in the underside of said body essentially centered with respect to said columns;

the thickness of said body of concrete between said top and bottom surfaces increasing progressively and gradually and substantially continuously in all directions outwardly from a crown portion of the dome recess to the periphery thereof;

the ratio of the diameter of a circle having an area equal to the area of the floor over the dome recess to the height of the dome recess at said crwon portion being between about 20 to 1 and 200 to 1;

said floor including a first group of tendons extending generally parallel to one another within said body of concrete and in a first generally horizontal direction, and a second group of tendons extending within said body of concrete in a second generally horizontal direction essentially perpendicular to said first group of tendons;

the tendons of each of said groups including a series of said tendons which extend through the concrete body above said dome recess at spaced locations and which as they extend across the dome recess they extend across the dome recess from one side thereof to the opposite side are bowed to advance first gradually away from the top surface to an intermediate location and then gradually closer to the top surface, and which are tensioned to apply an upward biasing force and a lateral compressive force on the body of concrete above said dome recess;

the tendons of each of said groups also including additional tendons laterally beyond said recess and each extending from one of said columns to another, and which advance first gradually away from said top surface to an intermediate location and then gradually closer to said top surface, and which are tensioned to apply an upward biasing force and a lateral compressive force on the concrete body between successive columns at the periphery of said region.

22. A building structure as recited in claim 21, in which each tendon is located closer to said top surface than to said bottom surface at its ends, and is located closer to said bottom surface than to said top surface at said intermediate location.

23. A building structure as recited in claim 22, in which said top surface of said concrete body is essentially planar, and said bottom surface of the concrete body has portions extending about said dome recess and between said support columns which are essentially planar and essentially parallel to said top surface of the concrete body.

24. A building structure as recited in claim 21, in which successive tendons of each of said groups of tendons are bowed progressively farther from said top surface at their centers to be closely proximate progressively lower portions of said dome recess.

25. A building structure comprising:

a series of generally vertically extending support columns projecting upwardly at spaced locations defining an essentially polygonal region; and a floor supported by said columns and extending generally horizontally across said polygonal region;

said floor including a monolithic integrally cast body of concrete having a planar top surface for supporting a load and having a bottom surface which, as it extends inwardly from said columns and across said region, has a portion advancing progressively and essentially continuously closer to said top surface to form a shallow concave essentially curved dome recess in the underside of said body essentially centered with respect to said columns;

the thickness of said body of concrete between said top and bottom surfaces increasing progressively and gradually and substantially continuously in all directions outwardly from a crown portion of the dome recess to the periphery thereof;

the ratio of the diameter of a circle having an area equal to the area of the floor over the dome recess to the height of the dome recess at said crown portion being between about 30 to 1 and 100 to 1;

said floor including a first group of tendons extending generally parallel to one another within said body of concrete and in a first essentially horizontal direction, and a second group of tendons extending within said body of concrete in a second generally horizontal direction essentially perpendicular to said first group of tendons;

the tendons of each of said groups including a series of said tendons which extend through the concrete body above said dome recess at spaced locations and which as they extend across the dome recess from one side thereof to the opposite side are bowed to advance first gradually away from said top surface to an intermediate location and then gradually closer to said top surface, and which are tensioned to apply an upward biasing force and a lateral compressive force on the body of concrete above said dome recess;

the tendons of each of said groups also including additional tendons laterally beyond said recess and each extending from one of said columns to another, and which advance first gradually away from said top surface to an intermediate location and then gradually closer to said top surface, and which are tensioned to apply an upward biasing force and a horizontal compressive force on the concrete body between successive columns at the periphery of said region;

each tendon having opposite ends located closer to said top surface than to said bottom surface, and being located closer to said bottom surface than to said top surface at said intermediate location;

said bottom surface having portions extending about said dome recess and between said columns which are planar and essentially parallel to said top surface.

* * * * *